US010466647B2

(12) United States Patent
Kanemitsu et al.

(10) Patent No.: US 10,466,647 B2
(45) Date of Patent: Nov. 5, 2019

(54) COOLING SYSTEM FOR AN IMAGE FORMING APPARATUS

(71) Applicant: SHARP KABUSHIKI KAISHA, Sakai, Osaka (JP)

(72) Inventors: Hiroki Kanemitsu, Sakai (JP); Shinichi Takeda, Sakai (JP); Noriaki Taguchi, Sakai (JP); Hiroki Shintani, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/200,270

(22) Filed: Nov. 26, 2018

(65) Prior Publication Data

US 2019/0163123 A1 May 30, 2019

(30) Foreign Application Priority Data

Nov. 30, 2017 (JP) ..... 2017-230623

(51) Int. Cl.
*G03G 21/00* (2006.01)
*G03G 15/00* (2006.01)
*G03G 21/20* (2006.01)

(52) U.S. Cl.
CPC ... *G03G 21/206* (2013.01); *G03G 2221/1645* (2013.01)

(58) Field of Classification Search
CPC ..... G03G 21/206; G03G 2221/1645
USPC ..... 399/92
See application file for complete search history.

(56) References Cited

U.S. PATENT DOCUMENTS

2006/0269314 A1* 11/2006 Lee ..... G03G 21/206 399/92
2007/0071485 A1* 3/2007 Yuasa ..... G03G 21/206 399/92
2009/0010672 A1* 1/2009 Watanabe ..... G03G 21/206 399/92
2011/0280609 A1* 11/2011 Nakazawa ..... G03G 21/206 399/92
2012/0045243 A1* 2/2012 Nishikawa ..... G03G 21/206 399/92
2015/0098724 A1* 4/2015 Mitorida ..... G03G 21/206 399/92

FOREIGN PATENT DOCUMENTS

JP 2010-210729 A 9/2010

* cited by examiner

*Primary Examiner* — Sophia S Chen
(74) *Attorney, Agent, or Firm* — ScienBiziP, P.C.

(57) ABSTRACT

An image forming apparatus includes a duct through which air taken in from outside a housing is sent into the housing, a blower fan provided at an upstream end of the duct, a toner bottle provided facing a wall surface of the duct, and a fixing section provided on a downstream side of the toner bottle. A component-facing section facing the toner bottle is formed to be smaller in cross-sectional area than a fan placement section. Therefore, by absorbing heat of air around the toner bottle via a wall of the component-facing section, the component-facing section prevents the toner bottle from becoming hot.

9 Claims, 4 Drawing Sheets

COOLING SYSTEM FOR AN IMAGE FORMING APPARATUS

BACKGROUND

1. Field

The present disclosure relates to an image forming apparatus including a duct through which air taken in from outside a housing is sent into the housing.

2. Description of the Related Art

Conventionally, an electrophotographic image forming apparatus fixes an image onto a sheet of paper by heating, under pressure, a toner image formed on the sheet of paper. During fixation, heat generated by heating a fixing roller holding the sheet of paper may affect surrounding members. Accordingly, there has been proposed a structure that cools down these members by sending air to an area around them (see, for example, Japanese Unexamined Patent Application Publication No. 2010-210729).

An image forming apparatus disclosed in Japanese Unexamined Patent Application Publication No. 2010-210729 includes a fixing section, a paper conveyance path, a blower fan, and a ventilation duct. The blower fan creates a current of air between inside and outside an apparatus body. The ventilation duct includes a plurality of openings for cooling down a unit located near the fixing section, the paper conveyance path, through which a sheet of paper is carried to the fixing section, a sheet of paper being conveyed through the paper conveyance path, a photosensitive drum, and the like. The openings are configured to fan them to cool them down.

A configuration in which a wind is sent into a space before fixation as in the case of the image forming apparatus disclosed in Japanese Unexamined Patent Application Publication No. 2010-210729 causes toner being developed or having already been developed to be scattered by the wind thus blown, so that the scattered toner may cause an image defect by adhering to the photosensitive drum, a transfer roller, a conveyance roller, and a sheet of paper being conveyed, or the like.

Further, doing miniaturization or the like of the image forming apparatus causes easy conduction of heat with internal units densely packed, so that more places are affected by fixing heat. Especially in an area around a developing device, particles of the toner fuse with each other under high temperature to cause an image defect, as the toner is weak against heat. Furthermore, the dense arrangement of components and units makes it difficult to secure a space for the duct. Therefore, there has been a demand for a structure that makes it possible to efficiently cool down a plurality of components and units in a narrow space without scattering toner.

It is desirable to provide an image forming apparatus including a duct that makes it possible not only to provide cooling by blowing out air taken in but also efficiently prevent an internal part from having a temperature rise under fixing heat.

SUMMARY

According to an aspect of the disclosure, there is provided an image forming apparatus including a blower fan that sucks in air from outside a housing and sends the air and a duct though which the air sent by the blower fan is guided into the housing. Assuming that a direction that the air is sent through the duct is a blowing direction and an area of a cross-section of the duct orthogonal to the blowing direction is a duct cross-sectional area, the blower fan is placed in a fan placement section of the duct, the duct has a component-facing section, provided on a downstream side of the fan placement section in the blowing direction, that is smaller in the duct cross-sectional area than the fan placement section, and at least a part of a wall constituting the component-facing section serves as a part of a wall forming an accommodation space of an internal component that is disposed inside the housing.

DESCRIPTION OF THE EMBODIMENTS

First Embodiment

An image forming apparatus according to a first embodiment of the present disclosure is described below with reference to the drawings.

Figure 1:
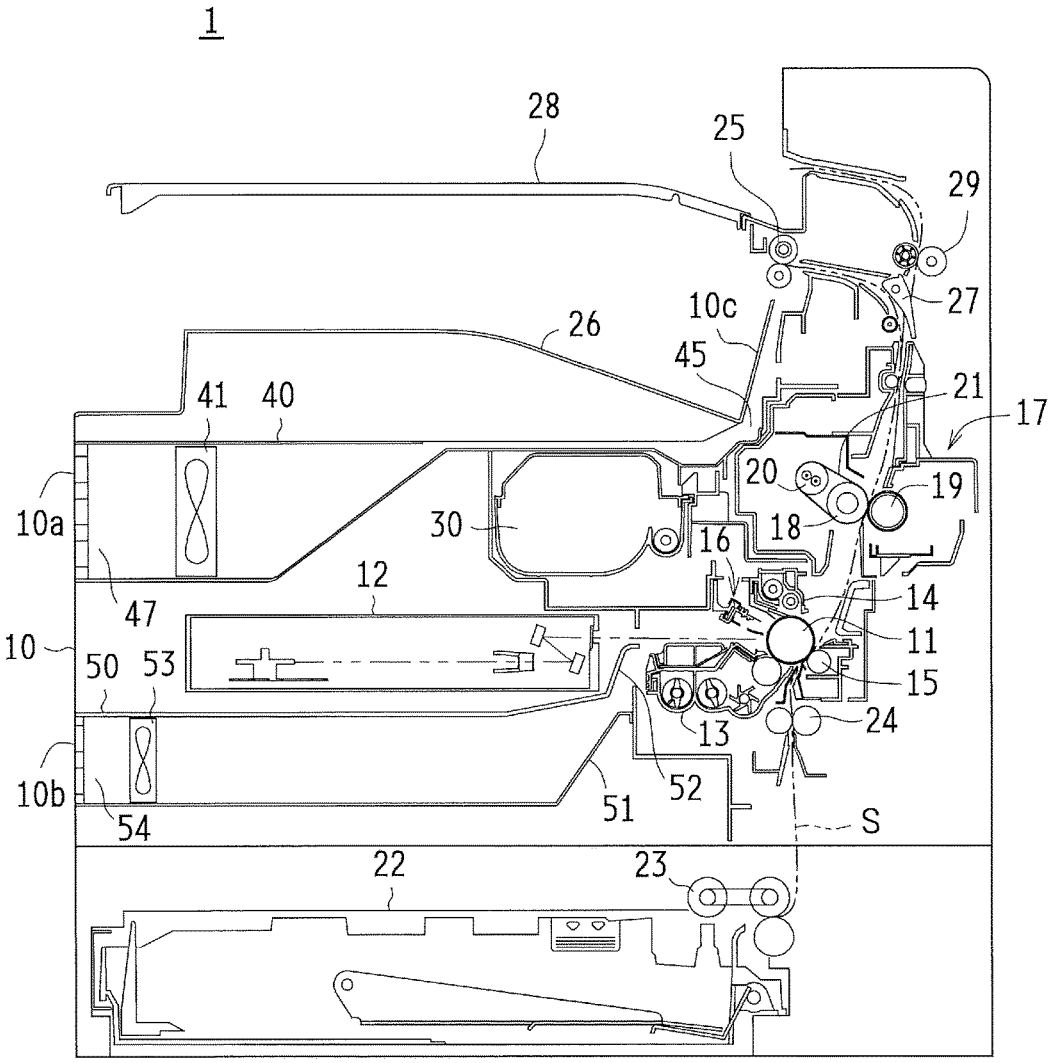
FIG. 1 is a side view schematically showing an image forming apparatus according to a first embodiment of the present disclosure.

FIG. 1 is a side view schematically showing an image forming apparatus according to a first embodiment of the present disclosure.

The image forming apparatus 1 forms an image on a predetermined sheet of paper in accordance with image data transmitted from an outside source. The image forming apparatus 1 has a housing 10 in which a photosensitive drum 11, an exposure device 12, a developing device 13, a cleaner device 14, a transfer roller 15, a charger 16, a fixing section 17 (which is an example of a process unit), a paper conveyance path S, a paper cassette 22, a paper output tray 26, an auxiliary tray 28, a toner bottle 30 (which is an example of an internal part), a duct 40, and an auxiliary duct 50 are provided.

The photosensitive drum 11 is disposed along the paper conveyance path S and driven to rotate. The charger 16 uniformly charges a surface of the photosensitive drum 11 to a predetermined potential. The exposure device 12 exposes the surface of the photosensitive drum 11 to light to form an electrostatic latent image on the surface of the photosensitive drum 11. The developing device 13 develops the electrostatic latent image on the surface of the photosensitive drum 11 to form a toner image on the surface of the photosensitive drum 11.

A nipping region is formed between the transfer roller 15 and the photosensitive drum 11, and the transfer roller 15 conveys a sheet of paper having been conveyed through the paper conveyance path S and being pinched in the nipping region. The toner image is transferred from the surface of the photosensitive drum 11 onto the sheet of paper when the sheet of paper passes through the nipping region. The cleaner device 14 removes and collects residual toner from the surface of the photosensitive drum 11 after development and image transfer.

The paper cassette 22 is a cassette in which to store a sheet of paper that is used for image formation, and is provided in a lower part of the housing 10. Further, the paper output tray 26, located in an upper part of the housing 10, is a tray on which to place a sheet of paper subjected to image formation. The auxiliary tray 28, located above the paper output tray 26, is a tray on which to place a sheet of paper subjected to image formation.

In the image forming apparatus 1, a sheet of paper fed from the paper cassette 22 passes through the paper conveyance path S to be sent to the paper output tray 26 via the transfer roller 15 and the fixing section 17. The paper conveyance path S, located close to one side wall of the housing 10 (in FIG. 1, rightward), is provided with a pickup roller 23, a registration roller 24, a branch guide 27, a paper output roller 25, and an auxiliary paper output roller 29.

The pickup roller 23, located near an end of the paper cassette 22, feeds sheets of paper one by one from the paper cassette 22 to the paper conveyance path S. The registration roller 24 temporarily holds a sheet of paper being conveyed from the paper cassette 22 and conveys the sheet of paper to the transfer roller 15 at such a timing that the front end of the toner image on the photosensitive drum 11 and the front end of the sheet of paper meet.

The fixing section 17 includes a fixing roller 18, a pressure roller 19, a heating roller 20, and a fixing belt 21. The fixing belt 21 is wound around the fixing roller 18 and the heating roller 20. The pressure roller 19 is pressed against the fixing roller 18 via the fixing belt 21. The fixing section 17 receives a sheet of paper with a toner image formed thereon unfixed and conveys the sheet of paper pinched between the fixing belt 21 and the pressure roller 19.

A sheet of paper subjected to fixation is conveyed to pass through the branch guide 27. The paper conveyance path S branches at the branch guide 27 into a path toward the paper output roller 25 and a path toward the auxiliary paper output roller 29 located above the paper output tray 25. A sheet of paper having passed through the paper output roller 25 is ejected onto the paper output tray 26, and a sheet of paper having passed through the auxiliary paper output roller 29 is ejected onto the auxiliary tray 28. Whether a sheet of paper subjected to image formation is ejected onto the paper output tray 26 or the auxiliary tray 28 can be controlled by motion of the branch guide 27.

The toner bottle 30, located above the exposure device 12 and near the fixing section 17 (in FIG. 1, on the left of the fixing section 17), has stored therein toner that is fed to the developing device 13. The duct 40, located between the paper output tray 26 and the exposure device 12, takes in air from outside the housing 10 and sends the air into the housing 10. The positions of the duct 40 and the toner bottle 30 will be described in detail later with reference to FIG. 2.

The auxiliary duct 50, located below the exposure device 12, takes in air from outside the housing 10 and sends the air into the housing 10. Specifically, the auxiliary duct 50 includes an auxiliary inlet 54 facing one side wall of the housing 10, an auxiliary outlet 52 facing the developing device 13, and an auxiliary fan 53 located near the auxiliary inlet 54. The auxiliary inlet 54 faces a side wall (in FIG. 1, left) of the housing 10 opposite to the paper conveyance path S, and the housing 10 has an auxiliary opening 10*b* provided in a position corresponding to the auxiliary inlet 54. The auxiliary opening 10*b* needs only be structured such than air can flow in, and may be a hole, such as a long narrow hole like a slit, that is smaller than the auxiliary inlet 54. Located near the auxiliary outlet 52 is an auxiliary duct cross-section reduction section 51 whose diameter becomes gradually smaller toward the auxiliary outlet 52.

Actuating the auxiliary fan 53 causes air to flow into the auxiliary duct 50 through the auxiliary inlet 54 and be blown toward the auxiliary outlet 52. The air thus blown becomes higher in flow rate as it passes through the auxiliary duct cross-section reduction section 51, whose diameter becomes smaller, thus making it possible to efficiently cool down the developing device 13.

Figure 2:
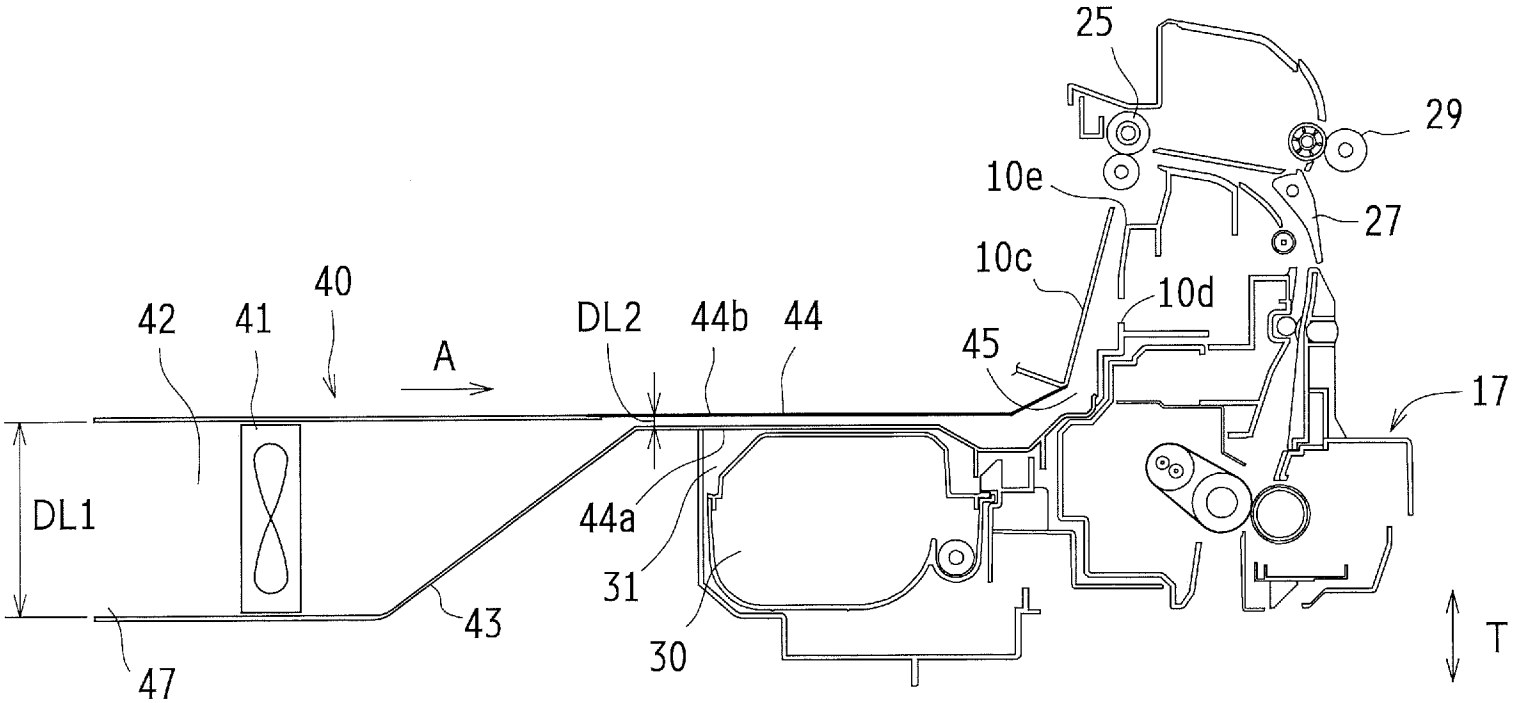
FIG. 2 is an enlarged view of the main components of a structure in and around a duct of FIG. 1.

FIG. 2 is an enlarged view of the main components of a structure in and around the duct 40 of FIG. 1.

FIG. 2 selectively shows the duct 40, the toner bottle 30, the fixing section 17, the paper output roller 25, and the like as the structure in and around the duct 40.

The duct 40 includes a cooling inlet 47 facing one side wall of the housing 10, a cooling outlet 45 facing an area around the fixing section 17, and a blower fan 41 located near the cooling inlet 47. The cooling inlet 47 faces a side wall (in FIG. 1, left) of the housing 10 opposite to the paper conveyance path S, and the housing 10 has a cooling opening 10*a* provided in a position corresponding to the cooling inlet 47. As with the auxiliary opening 10*b*, the cooling opening 10*a* may be a plurality of holes that are smaller than the cooling inlet 47.

Actuating the blower fan 41 causes air to flow into the cooling inlet 47 of the duct 40 through the cooling opening 10*a* and be blown toward the cooling outlet 45. For illustrative purposes, the following sometimes refers to the direction that air flows through the duct 40 as "blowing direction A", refers to a side of the cooling inlet 47 in the blowing direction A as "upstream side", and refers to a side of the cooling outlet 45 in the blowing direction A as "downstream side".

The blower fan 41 is placed in a fan placement section 42 near the cooling inlet 47 of the duct 40. The fan placement section 42 is configured such that the cross-sectional area of a cross-section perpendicular to the blowing direction A (hereinafter abbreviated as "duct cross-sectional area) becomes larger away from the downstream side for the purpose of sucking in as much air as possible from outside the housing 10 and attaching as large a blower fan 41 as possible to the duct 40. In the first embodiment, the blower fan 41 used is an axial-flow fan. In the configuration shown in FIG. 2, a part extending from the cooling inlet 47 to the fan placement section 42 is set so that the blower fan 41 and the duct 40 are substantially the same in cross-sectional area. In an alternative configuration, however, the duct cross-sectional area may become larger from the fan placement section 42 toward the upstream side.

Located on the downstream side of the blower fan 41 is a duct cross-section reduction section 43 whose duct cross-sectional area becomes gradually smaller toward the downstream side (in FIG. 2, rightward).

Located on the downstream side of the duct cross-section reduction section 43 is an component-facing section 44. The component-facing section 44 is disposed so that at least a part of a wall thereof faces the toner bottle 30. Specifically, the toner bottle 30 is disposed below the component-facing section 44. The wall of the component-facing section 44 facing the toner bottle 30 also serves as a wall of a toner bottle accommodation space 31 (which is an example of an accommodation space) in which the toner bottle 30 is accommodated.

For illustrative purposes, the following refers to a surface of the wall of the component-facing section 44 facing the toner bottle 30 as "facing surface 44*a*", refers to a surface of the wall of the component-facing section 44 opposite to the facing surface 44*a* as "covering surface 44*b*" with distinction, and refers to the direction that the facing surface 44*a* and the covering surface 44*b* face each other as "facing direction T".

Further, the component-facing section 44 is configured such that the component-facing section 44 is made smaller in duct cross-sectional area than the fan placement section 42 by the duct cross-section reduction section 43.

The duct cross-sectional area according to the first embodiment is described in detail. For illustrative purposes, a direction orthogonal to the facing direction T and the blowing direction A and parallel to the facing surface 44*a* is sometimes referred to as "wall surface direction H" (see FIG. 3 described below). The distance between inner walls of the fan placement section 42 in the facing direction T, i.e. the space (duct suction thickness DL1) between an upper surface of the duct 40 and a lower surface of the duct 40, is 80 mm. Further, the distance between inner walls of the fan placement section 42 in the wall surface direction H, i.e. the space between side surfaces of the duct 40 (duct suction width WL1, see FIG. 4 described below), is 80 mm. Accordingly, the fan placement section 42 has a duct cross-sectional area of 64 $cm^2$.

On the other hand, the distance between inner walls of the component-facing section 44 in the facing direction T, i.e. the space (duct ventilation thickness DL2) between the facing surface 44*a* and the covering surface 44*b*, is 4.5 mm. Further, the distance (duct ventilation width WL2) between inner walls of the component-facing section 44 in the wall surface direction H is 140 mm. Accordingly, the component-facing section 44 has a duct cross-sectional area of 6.3 $cm^2$. The component-facing section 44 has a long narrow rectangular cross-section extending for a long distance in the wall surface direction H with respect to the thickness direction of the wall and has half as large a duct cross-sectional area as the fan placement section 42 does or smaller.

A wind having passed through the fan placement section 42 flows directly into the component-facing section 44. Note here that since the amount of air per hour that passes through the duct 40 is constant with respect to a cross-section of the duct 40, the reduction in cross-sectional area causes the flow rate of air that flows through the component-facing section 44 to be higher than the flow rate of air that flows through the fan placement section 42. In the first embodiment, since the cross-sectional area is half as large or smaller, the flow rate is twice as high or higher.

Accordingly, even in the event of a rise in temperature of the tone bottle accommodation space 31 due to conduction of heat of the fixing section 17 to the interior of the apparatus, the toner bottle accommodation space 31 can be effectively cooled down by cooling down the facing surface 44*a* facing the toner bottle 30 at a high flow rate. That is, since a rise in temperature of the toner bottle accommodation space 31 can be efficiently suppressed, fusion of the toner in the toner bottle 30 can be prevented.

Further, in making the component-facing section 44 smaller in duct cross-sectional area, efficient cooling can be achieved by disposing the duct 40 in a place where the components are densely packed, as the cross-sectional shape of the duct 40 is a rectangular shape elongated in the wall surface direction H.

The cooling outlet 45, which leads to a blowing section 10*c* of the housing 10, is provided on the downstream side of the component-facing section 44. The blowing section 10*c*, having an empty space inside, includes a fixation downstream blowing hole 10*d* whose opening faces a space above the fixing section 17 and an upper blowing hole 10*e* whose opening faces an area around the paper output roller 25. A wind is sent through the fixation downstream blowing hole 10*d* to the paper conveyance path S on the downstream side of fixation. Although FIG. 2 distinguishes between the duct 40 and the blowing section 10*c*, the blowing section 10*c* may be deemed as a part of the duct 40, as the blowing section 10*c* is a ventilation member that guides air.

Thus, on the downstream side of the component-facing section 44, a plurality of cooling sections are provided to perform direct cooling by blowing air having passed through the duct 40.

The fixing section 17 is normally controlled at a high temperature of 150° C. in order to fix an unfixed toner image onto a sheet of paper by heating the unfixed toner image under pressure. Given these circumstances, providing the fixation downstream blowing hole 10*d* and the upper blowing hole 10*e* makes it possible to efficiently cool down a sheet of paper heated by passing through the fixing section 17, the paper output roller 25 heated by touching the sheet of paper, the paper conveyance path S, and the like.

Note here that although air blown out of the duct 40 becomes hotter than air outside the housing 10 by being subjected to heat of the toner bottle accommodation 31 when passing through the component-facing section 44, such a rise in temperature is at most approximately 10° C. In the first embodiment, a rise in temperature due to the influence of installation environment or continuous operation, if any, results in a temperature barely exceeding 60° C., as the toner bottle accommodation space 31 is away from the fixing section 17. Therefore, even with air subjected to the heat of the toner bottle accommodation space 31, a difference in temperature that is needed to cool down a sheet of paper, the paper output roller 25, and the like can be secured.

Moreover, in the component-facing section 44, direct cooling is not performed by blowing air, but indirect cooling is performed via the facing surface 44*a*. Therefore, air passing through the duct 40 is not mixed with toner having adhered to the toner bottle 30 or the like or toner having leaked from the toner bottle 30. Accordingly, no toner adheres to a sheet of paper or the paper output roller 25. This makes it possible to efficiently cool down a plurality of places (places differing in temperature) while preventing an image defect.

In the first embodiment, the fan placement section 42 is disposed in a place inside the image forming apparatus 1 where the components are not densely packed and there is comparatively enough space (in FIG. 1, the left-hand segment of the image forming apparatus 1). That is, disposing the blower fan 41 in a place where there is enough space makes it possible to apply a blower fan 41 of a larger size. This makes it possible to secure a volume of air that allows sufficient cooling and efficiently make use of space in the image forming apparatus 1.

Although the first embodiment is configured such that air taken in from outside the housing 10 blows out inside the housing 10, this does not imply any limitation. In an alternative configuration, air taken in from outside may blow out of the housing 10 after having cooled down the units inside the housing 10 through the duct 40.

Second Embodiment

Next, an image forming apparatus according to a second embodiment of the present disclosure is described with reference to the drawings. It should be noted that a description and illustration of a structure of the image forming apparatus according to the second embodiment are omitted, as the structure is substantially the same as that of the first embodiment.

Figure 3:
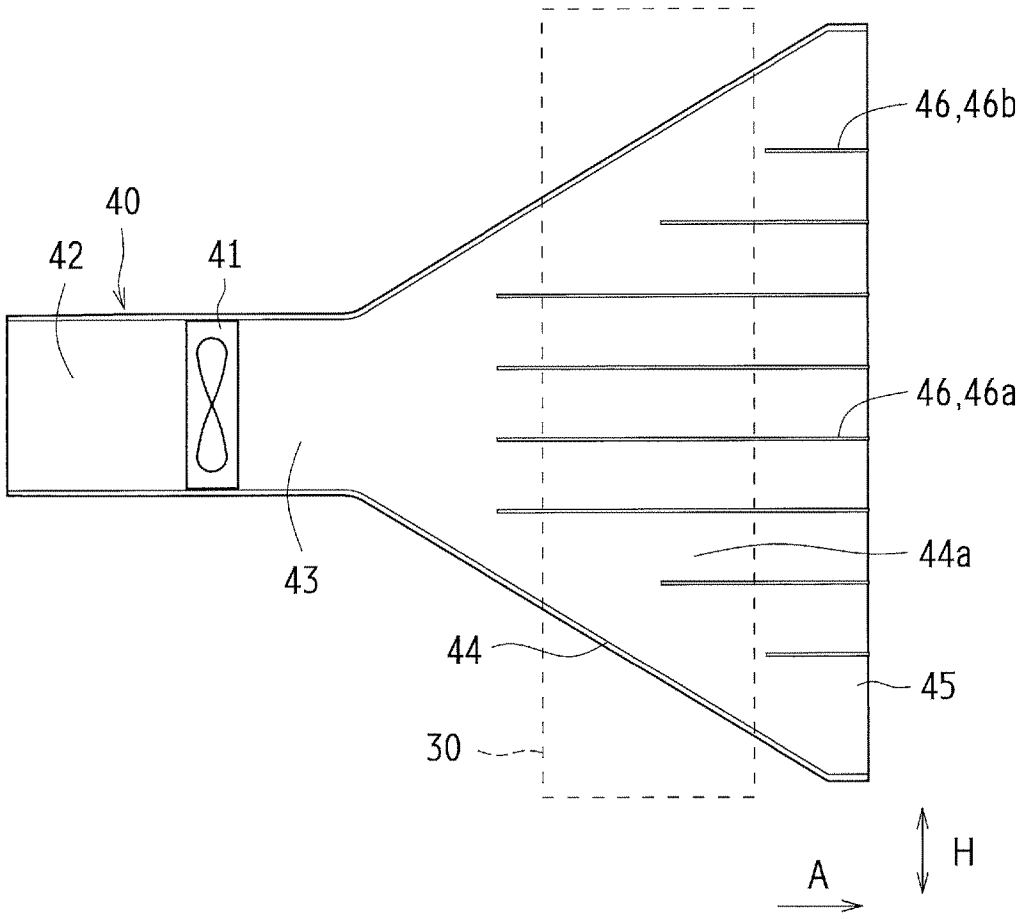
FIG. 3 is a schematic cross-sectional view of the duct in a top view.

FIG. 3 is a schematic cross-sectional view of the duct 40 in a top view.

FIG. 3 is a schematic cross-sectional view showing a lower surface side of the duct 40, and shows a positional relationship between the duct 40 and the toner bottle 30 located therebelow. For illustrative purposes, the following sometimes refers to a direction orthogonal to the facing direction T and the blowing direction A and parallel to the facing surface 44*a* as "wall surface direction H".

The second embodiment differs from the first embodiment in terms of shape of the duct 40. Specifically, the component-facing section 44 is formed to become larger in width in the wall surface direction H toward the downstream side. That is, the component-facing section 44 is configured such that the width (duct ventilation width WL2) of an inlet side of the component-facing section 44 is narrower than the width (duct exhaust width WL3, see FIG. 4 described below) of an outlet side of the component-facing section 44.

As shown in FIG. 3, while the toner bottle 30 is formed to be large in width in the wall surface direction H, the fan placement section 42 is smaller in width in the wall surface direction H than the toner bottle 30. Given these circumstances, the component-facing section 44 is configured to become wider in width in the wall surface direction H toward the downstream side to have a wider area facing the toner bottle 30, thereby being able to efficiently receive heat from the toner bottle 30.

Specifically, the duct exhaust width WL3 is 260 mm, and the duct ventilation thickness DL2 is 4.5 mm. That is, the cross-sectional area of the component-facing section 44 on the downstream wide is 11.7 cm2, which is smaller than the duct cross-sectional area of the fan placement section 42. As a result, the component-facing part 44 is lower in flow rate on the outlet side than on the inlet side. However, since the component-facing section 44 is still higher in flow rate than the fan placement section 42, the high flow rate, combined with a wider area facing the toner bottle 30, can bring about improvement in cooling efficiency. Further, a wider width along the blowing direction A makes it possible to expand the range of cooling while minimizing turbulence of air.

Further, the component-facing section 44 is provided with a rectifying rib 46 extended in the blowing direction A. A plurality of the rectifying ribs 46 are placed at intervals from each other in the wall surface direction H, and a rectifying rib 46 (first rectifying rib 46*a*) located in the center in the wall surface direction H is extended longer in the blowing direction A than a rectifying rib 46 (second rectifying rib 46*b*) located at an end in the wall surface direction H. Specifically, the first rectifying rib 46*a* and the second rectifying rib 46*b* have their downstream ends aligned so as to be located at the cooling outlet 45 and have their upstream ends differing in position. That is, the first rectifying rib 46*a* has its upstream end located near the duct cross-section reduction section 43, and the second rectifying rib 46*b* has its upstream end located closer to the cooling outlet 45 than that of the first rectifying rib 46*a*.

Providing the rectifying ribs 46 aligns the direction of flow of air with the blowing direction A, thus making it possible to suppress a reduction in flow rate due to turbulence. Further, since the component-facing section 44 is configured to become larger in width in the wall surface direction H toward the downstream side of the blowing direction A, the arrangement of rectifying ribs 46 makes it possible to more efficiently rectify the flow of air. Specifically, since air sent from the blower fan 41 easily concentrates in the center in the wall surface direction H, lengthening a rectifying rib 46 that is equivalent to a central part increases the conduit resistance of air flowing through a duct space divided by the rectifying ribs 46, thus making it hard for the air to flow. Since the air hardly flows through the central part, the air can be dispersed toward the ends, so that a wide area can be cooled down in a balanced manner.

Further, the lengths of the rectifying ribs 46 in the blowing direction A may be adjusted as appropriate depending on positions in the wall surface direction H. That is, a rectifying rib 46 located closer to an end of the component-facing section 44 in the wall surface direction H may be shorter than a rectifying rib 46 located farther away from the end. In the structure shown in FIG. 3, the lengths of the rectifying ribs 46 are classified into three levels. Alternatively, the lengths of the rectifying ribs 46 may be classified into more levels.

Third Embodiment

Next, an image forming apparatus according to a third embodiment of the present disclosure is described with reference to the drawings. It should be noted that a description and illustration of a structure of the image forming apparatus according to the third embodiment are omitted, as the structure is substantially the same as those of the first and second embodiments.

Figure 4:
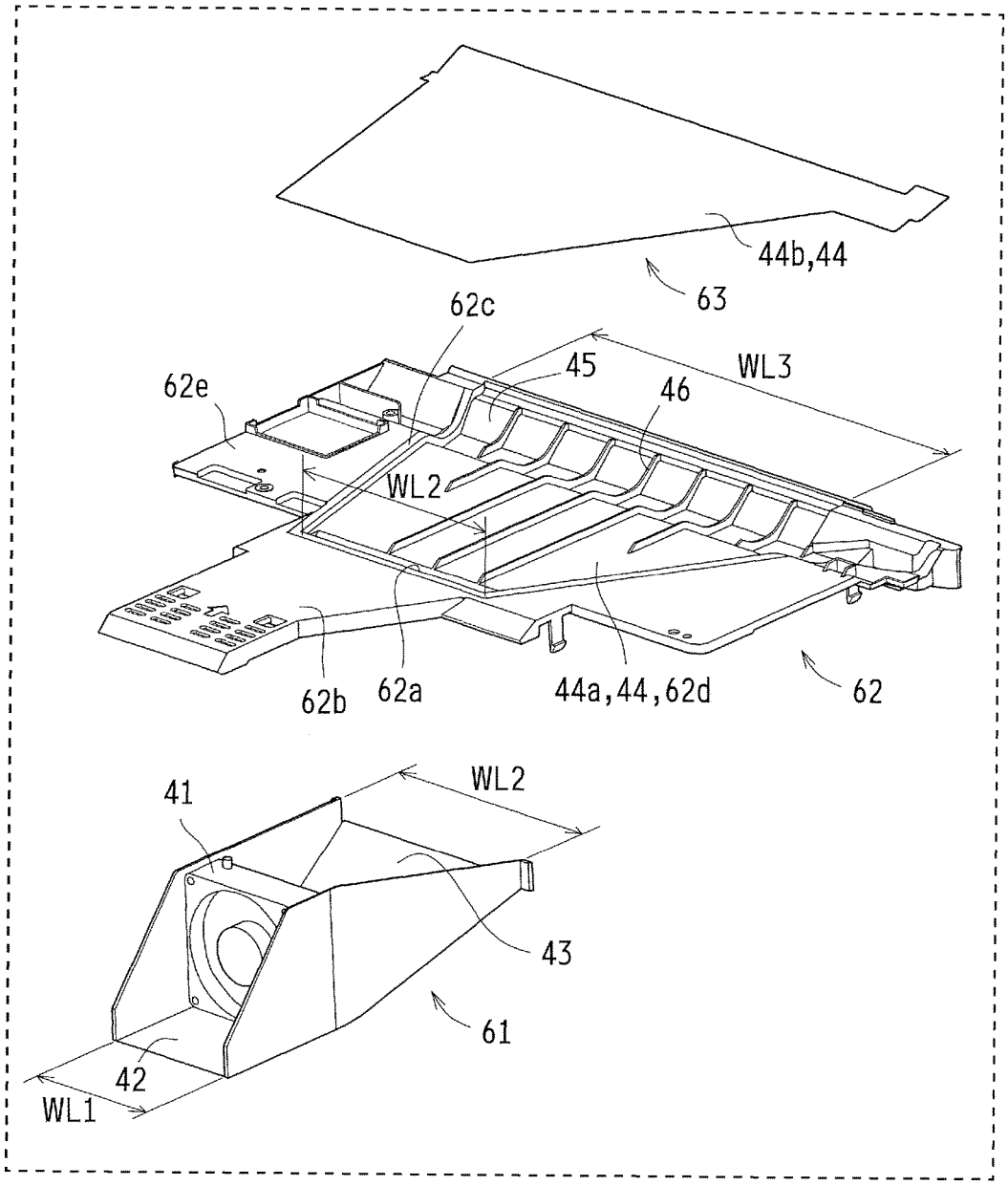
FIG. 4 is an exploded perspective view showing a state where members constituting the duct are separated.

FIG. 4 is an exploded perspective view showing a state where members constituting the duct 40 are separated.

The third embodiment differs from the second embodiment in terms of members constituting the duct 40. The duct 40 is constituted mainly by a fan fixing section 61, a toner bottle cooling section 62, and a duct cover 63.

The fan fixing section 61 corresponds to lower surface sides of the fan placement section 42 and the duct cross-section reduction section 43, with the blower fan 41 fixed thereto. The fan fixing section 61 may be integrally configured as a part of the housing 10.

The toner bottle cooling section 62 corresponds to upper surface sides of the fan placement section 42 and the duct cross-section reduction section 43 and to the facing surface 44*a* of the component-facing section 44, and is a plate member provided with projections and depressions. This configuration makes it possible to form a duct passageway by collectively sealing ceiling parts of the fan placement section 42 and the duct cross-section reduction section 43 and a ceiling part of the toner bottle accommodation space 31.

The toner bottle cooling section 62 has a main part 62*d* corresponding to the facing surface 44*a*, a suction side upper surface part 62*b*, and an attaching part 62*e*. The main part 62*d* differs in height (position) in the facing direction T from the suction side upper surface part 62*b* and the attaching part 62*e*. The suction side upper surface part 62*b* and the attaching part 62*e* are located above the main part 62*d* in the facing direction T.

The toner bottle cooling section 62 has a standing part 62*c* provided as a step on a boundary between the main part 62*d* and the suction side upper surface part 62*b* and a boundary between the main part 62*d* and the attaching part 62*e*, and a part of the standing part 62*c* corresponds to a side wall of the duct 40 in the component-facing section 44. That is, the step provided by the standing part 62*c* is equivalent to the distance (duct ventilation thickness DL2) between inner walls of the aforementioned component-facing section 44 in the facing direction T. The attaching part 62*e* is extended outward from the main part 62*d* in the wall surface direction H, and is provided with projections and screw holes for attaching the toner bottle cooling section 62 to the housing 10. When the toner bottle cooling section 62 has been attached to the housing 10 via the attaching part 62*e*, the suction side upper surface part 62*b* overlaps the fan fixing section 61. A ventilation hole 62*a* bored through a boundary between the main part 62*d* and the suction side upper surface part 62*b* in the blowing direction A leads to an upper end of the duct cross-section reduction section 43 in the fan fixing section 61. That is, air having passed through the duct cross-section reduction section 43 is sent into the component-facing section 44 via the ventilation hole 62*a*.

The duct cover 63 corresponds to the covering surface 44*b* of the component-facing section 44, is constituted by a thinner sheet material than the toner bottle cooling section 62, and has its edge fixed to the standing part 62*c*.

As mentioned above, the duct 40 may be divided into a plurality of members that are combined to constitute a ventilation member having an empty space inside. Moreover, the fan fixing section 61, the toner bottle cooling section 62, and the duct cover 63 may be formed by different members, respectively. That is, of the wall surfaces of the component-facing section 44, the facing surface 44*a* and the covering surface 44*b* may be constituted by different members. The degree of cooling of the facing surface 44*a* can be adjusted according to the member by which it is constituted. Further, the degree of freedom of design of the covering surface 44*b* can be improved by constituting it as a separate entity without needing to stick to the member of the facing surface 44*a*. That is, since the component-facing section 44 is configured such that one surface thereof (i.e. an upper surface of the toner bottle cooling section 62) is open, it becomes easy to integrally mold rectifying ribs 46 that are low in height.

In the third embodiment, the toner bottle cooling section 62 is made of ABS resin, and the duct cover 63 is made of a PET material. Alternatively, either of the members may be made of metal or the like. That is, when made of a metal having good thermal conductivity, the toner bottle cooling section 62 can further enhance the efficiency of absorption of heat from the toner bottle accommodation space 31. Similarly, the toner bottle cooling section 62 may be made of a resin material to which carbon has been added, or may have its cooling ability reduced by being formed by a resin material mixed with glass fiber. Further, ABS resin may be replaced by a material mixed with a PET material or by another engineering resin. Thus, as for the material to be applied, it is only necessary to appropriately select an appropriate material in consideration of the thickness and required thermal quality of the toner bottle cooling section 62.

It should be noted the embodiments disclosed herein are examples in all respects and are not intended to serve as a basis for limited interpretation. Accordingly, the technical scope of the present disclosure is not intended to be interpreted solely by the embodiments described above, but is defined on the basis of the recitations in the claims. Further, all modifications falling within the meaning and range of the equivalent of the claims are encompassed.

The present disclosure contains subject matter related to that disclosed in Japanese Priority Patent Application JP 2017-230623 filed in the Japan Patent Office on Nov. 30, 2017, the entire contents of which are hereby incorporated by reference.

What is claimed is:

1. An image forming apparatus comprising:

a blower fan that sucks in air from outside a housing and sends the air; and a duct though which the air sent by the blower fan is guided into the housing, wherein assuming that a direction that the air is sent through the duct is a blowing direction and an area of a cross-section of the duct orthogonal to the blowing direction is a duct cross-sectional area, the blower fan is placed in a fan placement section of the duct, the duct has a component-facing section, provided on a downstream side of the fan placement section in the blowing direction, that is smaller in the duct cross-sectional area than the fan placement section, and at least a part of a wall constituting the component-facing section serves as a part of a wall forming an accommodation space of an internal component that is disposed inside the housing, wherein the component-facing section is provided with at least one rectifying rib extended in the blowing direction.

2. The image forming apparatus according to claim 1, wherein a cross-sectional shape of the component-facing section is a rectangular shape set to have a greater length in a wall surface direction along a surface of the wall than in a thickness direction of the wall.

3. The image forming apparatus according to claim 2, wherein at least one rectifying rib comprises a plurality of rectifying ribs placed at intervals in the wall surface direction.

4. The image forming apparatus according to claim 3, wherein a rectifying rib of the component-facing section located in a center in the wall surface direction is extended longer in the blowing direction than a rectifying rib of the component-facing section located at an end in the wall surface direction.

5. The image forming apparatus according to claim 2, wherein the component-facing section is formed to become greater in width in the wall surface direction toward a downstream side in the blowing direction.

6. The image forming apparatus according to claim 1, wherein the wall of the component-facing section is constituted by a member different from the fan placement section.

7. The image forming apparatus according to claim 6, wherein a facing surface of the wall of the component-facing section facing the internal component and a covering surface of the wall of the component-facing section opposite to the facing surface are constituted by different members, respectively.

8. The image forming apparatus according to claim 1, further comprising an opening, provided on a downstream side of the component-facing section in the blowing direction, through which the air is blown out.

9. The image forming apparatus according to claim 1, wherein the duct includes a duct cross-section reduction section in which the duct cross-sectional area becomes gradually smaller toward a downstream of the blowing direction, wherein the duct cross-section reduction section is disposed between the blower fan and the component-facing section in the blowing direction.

* * * * *